United States Patent [19]

Radermacher

[11] Patent Number: 4,865,522

[45] Date of Patent: Sep. 12, 1989

[54] FUEL PUMP FOR AN INTERNAL COMBUSTION ENGINE HAVING TWO PUMP UNITS

[75] Inventor: Bernhard Radermacher, Viersen, Fed. Rep. of Germany

[73] Assignee: Pierburg GmbH, Neuss, Fed. Rep. of Germany

[21] Appl. No.: 176,702

[22] Filed: Apr. 1, 1988

[30] Foreign Application Priority Data

Apr. 18, 1987 [DE] Fed. Rep. of Germany ..... 3713276

[51] Int. Cl.[4] ..... F04B 23/14; F04B 39/12

[52] U.S. Cl. ..... 417/203; 417/363; 417/368; 415/55.1

[58] Field of Search ..... 417/199.2, 200, 203, 417/205, 363, 366, 368, 369, 423.3, 423.5, 423.14, 423.15; 415/53 R, 53 T, 213 T

[56] References Cited

U.S. PATENT DOCUMENTS

| | | | |
|---|---|---|---|
| 2,843,315 | 7/1958 | Faith-ell | 417/363 X |
| 2,973,895 | 3/1961 | Brown et al. | 417/363 |
| 3,443,519 | 5/1969 | White | 417/366 |
| 4,231,719 | 11/1980 | Ringwald et al. | 417/366 |
| 4,306,844 | 12/1981 | Otto et al. | 417/363 X |
| 4,309,155 | 1/1982 | Heinz et al. | 417/363 X |
| 4,336,002 | 6/1982 | Rose et al. | 417/366 X |
| 4,590,964 | 5/1986 | Beardmore | 417/363 |

*Primary Examiner*—Carlton R. Croyle
*Assistant Examiner*—Eugene L. Szczecina, Jr.
*Attorney, Agent, or Firm*—Roberts, Spiecens & Cohen

[57] ABSTRACT

A fuel feed device having a first pump assembled with an electric motor in a sheet-metal shell to form a self-contained unit. The drive shaft of the motor projects from the unit and is drivingly connected to an impeller of a second pump whose housing surrounds the impeller. The housing of the second pump surrounds part of the self-contained unit and a sleeve is pushed over the self-contained unit with clearance therebetween and is connected at its lower end to the second pump housing and forms a seal with the self-contained unit by a holding ring and an elastic membrane. The device is easily adapted to casings of the first pump of any form and shape and to requirements, such as changes in filter size, mounting in the fuel tank, and for different types of second pumps.

11 Claims, 1 Drawing Sheet

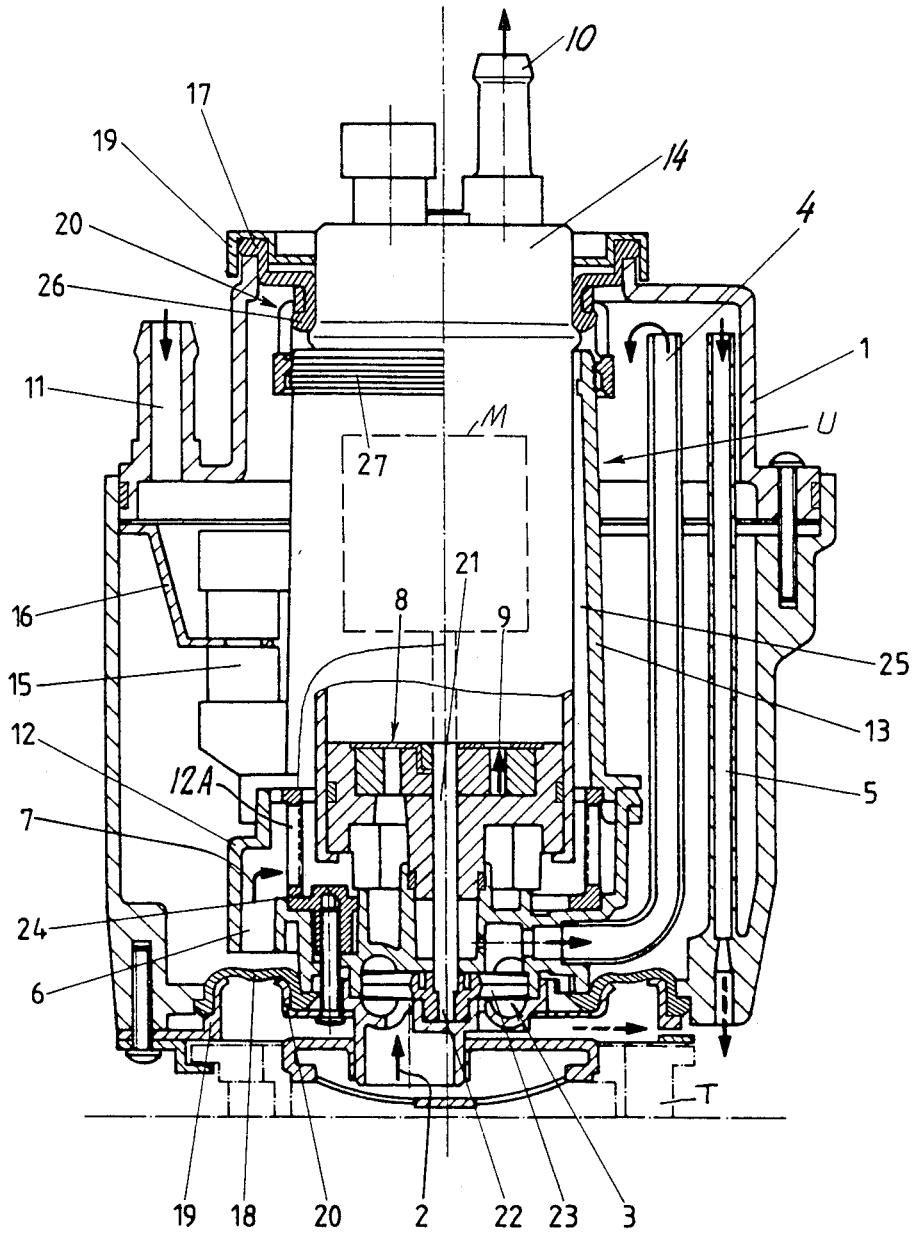
10
17
19
14
4
20
26
1
11
M
U
27
21
8
9
16
25
15
13
12
12A
5
7
24
6
T
19
18
20
2
22
23
3

FUEL PUMP FOR AN INTERNAL COMBUSTION ENGINE HAVING TWO PUMP UNITS

FIELD OF THE INVENTION

The present invention relates to a fuel supply means for an internal combustion engine adapted for installation in the fuel tank of an automotive vehicle and more particularly to a fuel supply means having two pumps mounted on a drive shaft of an electric motor.

PRIOR ART

A fuel supply means of this type is disclosed in FRG Application DE-OS 35 32 349. In this construction, when the fuel tank is almost empty, a sufficient supply of fuel is available for travel around bends. Additionally, when the fuel is hot there is a separation of air bubbles and liquid fuel and only the liquid fuel, free of air bubbles, is present at the inlet to the second pump.

SUMMARY OF THE INVENTION

Since such a device is more expensive than a conventional electric pump, an object of the present invention is to provide a fuel supply means with two pumps which is simple in construction and less expensive in cost.

A further object of the invention is to provide a fuel supply means of the above type in which the number of expensive mounting elements and structural parts by which the two pumps are assembled together into a single unit are reduced.

The above and further objects are achieved according to the invention by the provision of a fuel supply apparatus which comprises first and second pumps drivingly connected to a drive shaft of a drive motor and wherein the second pump and drive motor are assembled together as a unit from which the drive shaft of the motor extends for connection to the first pump whose housing surrounds the unit with clearance and is secured to a sleeve into which the unit is inserted with clearance. The sleeve is sealingly connected to the unit by a holding ring and an elastic seal element.

In order to provide axial adjustment between the unit and the sleeve in the assembled condition, a plurality of axially spaced grooves are provides in the sleeve and the holding ring is selectively engaged in one of the grooves to clamp the elastic seal element against the unit in axially adjustable relation of the sleeve and the unit.

In an advantageous embodiment, the housing of the first pump contains a fuel filter for fuel flowing from the interior of the outer casing of the apparatus and the inlet for the second pump.

BRIEF DESCRIPTION OF THE FIGURE OF THE DRAWING

The sole FIGURE of the drawing is a side elevational view partly broken away and in section of an embodiment of a fuel supply means according to the invention.

DETAILED DESCRIPTION OF A PREFERRED EMBODIMENT OF THE INVENTION

Referring to the drawing, therein is seen a casing 1 forming a fuel reservoir mounted in a fuel tank T (only a portion of which is shown in phantom) of an automotive vehicle. Fuel flows from the fuel tank, in the direction of arrow 2 into a side channel pump 3 which pumps the fuel into a riser conduit 4 and then into the interior of casing 1 which forms the fuel reservoir.

In the interior of casing 1, air bubbles separate from the liquid fuel and are discharged from the reservoir in casing 1 through a conduit 5 into the fuel tank. The fuel which has been pumped by the pump 3 into the reservoir in casing 1 flows through an inlet 6 in the direction of arrow 7 into a second pump constituted as an internal gear pump 8. The pump 8 conveys the fuel in the direction indicated by arrow 9, under the drive of an electric motor M, through an outlet 10 to a utilization means (not shown), for example, a mixture-forming device for an internal combustion engine, such as a carburetor or fuel injection apparatus.

Excess fuel from the utilization means passes through a return inlet 11 back into the reservoir in casing 1.

Disposed within the casing 1 is a structural unit U which includes, in assembled state, pumps 3 and 8 and the electric motor M. The pump 8 and motor M are assembled in a shell 14 of unit U and shell 14 is, in turn, mounted in an outer housing of unit U formed by a housing 12 of pump 3 and a sleeve 13 secured to housing 12. The housing 12 contains a filter 12A through which fuel flows from the reservoir in casing 1 to pump 8.

The assembly comprised of shell 14, sleeve 13 and housing 12 is secured to the casing 1 by a vibration damping means constituted by three or more elastic supports 15 secured to sleeve 13 at equal spacing around the circumference of sleeve 13, the supports 15 being secured to support plates 16 fixed to casing 1.

The shell 14 is a sheet metal housing in which the pump 8 and motor M are assembled as a single self-contained unit.

At the upper and lower ends of the casing 1, there are respectively mounted flexible seals 17, 18 in the form of elastic rings. The seals 17, 18 are clamped to the casing 1 at their outer ends by holding rings 19 and at their inner ends the seals 17, 18 are respectively clamped to shell 14 and housing 12 by holding rings 20. In this way, the structural unit U is sealed within casing 1 and resiliently mounted therein and transfer of vibration from the electric motor and the pump to the casing 1 and thus to the fuel tank is prevented. Consequently, noise generated in the fuel tank by the vibrations of the electric motor and of the pumps is avoided.

The shell 14 can contain a conventional fuel pump in which case there is used merely an extended drive shaft 21 which extends beyond pump 8 and is secured to pump 3 by forming a necked down portion 22 on which a blade wheel 23 which forms an impeller of pump 3 is press-fit. The housing 12 receives the blade wheel 23 and forms therewith a side channel pump construction. The filter 12A serves as a fuel filter for fuel entering pump 8. Although the pump 3 has been disclosed as a side channel pump, it can also be a pump of different construction.

The housing 12 surrounds a portion of the shell 14 with clearance and is connected at the end thereof remote from the pump 3 to the sleeve 13 into which the shell 14 is inserted with formation of a gap 25. The sleeve 13 is clamped at its upper end to the shell 14 by a holding ring 20 and by the inner end 26 of flexible seal 17. Instead of forming the sealed connection at the shell 14, by the inner end 26 of seal 17, the sealed connection can be formed by an element separate from seal 17.

The assembly of the device is very simple in view of the arrangement described and can be carried out without the use of special tools. Housing 12 and upper holding ring 20 can be connected to the sleeve 13 at its opposite ends by clips (not shown). However, preferably, the sleeve 13 is provided at its upper end with a plurality of spaced outer grooves 27 into which a mating part of the upper holding ring 20 is engaged to secure sleeve 13 to the shell 14 through seal 17 in an axially adjustable position. By this construction, upon assembly, the inner end 26 of seal 17 can be stretched and can form a seal against the shell 14 without the need to maintain close tolerances in the length of the structural parts as in the case of clip attachment.

By reason of the possibility of using a conventional fuel pump, merely with a different length of shaft, the stocking of the pump parts and the manufacturing construction are simplified. The pumps can be produced at low cost at the place of use. By the construction described, it is possible to adapt the pump 3 and its associated equipment, such as its filters and suspension, in flexible manner at the place of installation without having to change the unit composed of the drive motor and pump 8.

While the invention has been described in relation to a specific embodiment thereof, it will become apparent to those skilled in the art that numerous modifications and variations can be made within the scope and spirit of the invention as defined in the attached claims.

What is claimed is:

1. A fuel supply apparatus for an internal combustion engine adapted for installation in the fuel tank of an automotive vehicle, comprising an outer casing adapted for connection to a fuel tank and defining a fuel reservoir in the casing, a drive motor having a drive shaft, first and second pumps drivingly connected to said drive shaft, a common housing for said second pump and said drive motor connecting the same together in a unit, said drive shaft including a portion extending from said unit and beyond said common housing, said portion of said drive shaft which extends from said unit comprising a shaped portion, said first pump including an impeller fixed to said shaped portion and thereby being drivingly connected to the portion of the drive shaft extending from said unit, said first pump including a housing surrounding a portion of said unit and the portion of the drive shaft projecting from said unit, a sleeve surrounding said unit with clearance and connected to said housing, means sealingly connecting said sleeve to said unit and including a holding ring and an elastic seal element and a riser conduit coupled to said second pump at an outlet thereof and extending to an upper region of the casing, said housing of said first pump having an inlet for flow of fuel from the reservoir to the first pump, said inlet being in a lower region of said casing.

2. A fuel supply apparatus as claimed in claim 1 wherein said impeller is press-fit on said drive shaft.

3. A fuel supply apparatus as claimed in claim 1 wherein said means which sealingly connects said sleeve to said unit includes a connection capable of sealingly connecting said sleeve and said unit in various relative axial positions of said sleeve and said unit.

4. A fuel supply apparatus as claimed in claim 3 wherein said connection comprises a plurality of axially spaced grooves in said sleeve, a holding ring engageable in a selected groove and a flexible seal clamped between said holding ring and said common housing of said unit.

5. A fuel supply apparatus as claimed in claim 4 wherein said common housing comprises a shell enclosing said drive motor and securing said second pump therein.

6. A fuel supply apparatus as claimed in claim 1 comprising means for supporting a fuel filter in said inlet of the housing of said first pump.

7. A fuel supply apparatus as claimed in claim 1 comprising means resiliently supporting said sleeve from said casing.

8. A fuel supply apparatus as claimed in claim 7 comprising resilient seal means between the housing of said first pump and said casing.

9. A fuel supply apparatus as claimed in claim 8 wherein said means which sealingly connects said sleeve to said unit includes a connection capable of sealingly connecting said sleeve and said unit in various relative axial positions of said sleeve and said unit, said connection comprising a plurality of axially spaced grooves in said sleeve, a holding ring engageable in a selected groove and a flexible seal clamped between said holding ring and said common housing of said unit.

10. A fuel supply apparatus as claimed in claim 1 comprising an air conduit in said casing having an inlet communicating with said reservoir and an outlet communicating externally of said casing.

11. A fuel supply apparatus as claimed in claim 10 wherein said air conduit extends adjacent to said riser conduit, said air and riser conduits having adjacent upper open ends.

* * * * *